US005707680A

United States Patent [19]

Moore

[11] Patent Number: 5,707,680

[45] Date of Patent: Jan. 13, 1998

[54] METHOD FOR REDUCING INVALID ACCEPTANCES OF EXPIRED PRINTED OFFERS AND END-CONSUMER RE-DISTRIBUTION OF PRINTED WORKS

[76] Inventor: Steven Jerome Moore, 9 Sonoma Rd., New York, N.Y. 10566

[21] Appl. No.: 581,805

[22] Filed: Jan. 2, 1996

[51] Int. Cl.[6] ..... B41M 3/14

[52] U.S. Cl. ..... 427/7; 116/206; 116/208; 283/95; 283/51; 283/901

[58] Field of Search ..... 427/7; 116/208, 116/207, 201, 206; 283/95, 51, 901

[56] References Cited

U.S. PATENT DOCUMENTS 1,167,566 1/1916 Jenkins ..... 427/7

*Primary Examiner*—Shrive Beck
*Assistant Examiner*—Bret Chen

[57] ABSTRACT

There is disclosed a method for the time-delayed defacement of all or part of a printed work, such as a time-dependent coupon. Such method comprises applying opaque print onto a substrate and applying an opacity-labile composition of lesser nascent opacity than the visible print onto the substrate in such a manner that a change in the opacity of the opacity-labile composition causes a time-delayed defacement of the printed substrate.

20 Claims, 4 Drawing Sheets

A.

THE BIG STORY OF THE DAY!

(cont. from page 1)

Mayor Big commented that the big event may become the biggest of its kind in Big City.

Big City police chief, V. Bigger, cautioned that big crowds and big traffic jams should be expected on the day of the big event.

Unfortuately, the weather forecast suggests that the big event may be marred by a big storm that is expected in the Big City area on Friday.

THE SMALL STORY OF THE DAY

In a small turn of events, the city clerk, Betty Small, announced that the property tax mill rate would increase a small 1/1,000,000 of a cent next October 1. There had been small talk concerning a possible rate hike circulating through the town for a least the last six months.

B.

~~THE BIG STORY OF THE DAY!~~

(cont. from page 1)

~~Mayor~~ Big commented that the big event may become the biggest of its kind in ~~Big City.~~

~~Big City police~~ chief, V. Bigger, cautioned that big crowds and big traffic jams should be expected on the day of the big ~~event.~~

Unfortuately, the weather forecast suggests that the big event may be marred by a big storm that is expected in the Big City area on Friday.

THE SMALL STORY OF THE DAY

In a small turn of events, the city clerk, Betty Small, announced that the property tax mill rate would increase a small 1/1,000,000 of a cent next October 1. There had been small talk concerning a possible rate hike circulating through the town for a least the last six months.

C.

~~THE BIG STORY OF THE DAY!~~

(cont. from page 1)

~~Mayor Big commented that the big event may become the biggest of its kind in Big City.~~

~~Big City police chief, V. Bigger, cautioned that big crowds and big~~ traffic jams ~~should be expected on the day of the big event.~~

~~Unfortuately~~, the weather forecast ~~suggests~~ that the big event may ~~be marred by a big storm that is expected in the Big City area on Friday~~.

THE SMALL STORY OF THE DAY

In a small turn of events, the city clerk, Betty Small, announced that the property tax mill rate would increase a small 1/1,000,000 of a cent next October 1. There had been small talk concerning a possible rate hike circulating through the town for a least the last six months.

FIG. 3

Then raising the dagger in his hand, Inspector Hanson turned on his feet and pronounced, "The murderer is in this room."

Clarissa, the maid, Jives, the butler, Captain Blythe, Doctor Persy, and Sam Slick stared at one another in disbelief.

"I intend now to reveal the perpetrator of this heinous crime," Inspector Hanson continued with a broad smile across his face, "it is none other than Jives!"

Angered at having been discoverered, and facing the

A.

Then raising the dagger in his hand, Inspector Hanson turned on his feet and pronounced, "The murderer is in this room."

Clarissa, the maid, Jives, the butler, Captain Blythe, Doctor Persy, and Sam Slick stared at one another in disbelief.

"I intend now to reveal the perpetrator of this heinous crime," Inspector Hanson continued with a broad smile across his face, "it is none other than [redacted]

Angered at having been discoverered, and facing the

B.

FIG. 4

METHOD FOR REDUCING INVALID ACCEPTANCES OF EXPIRED PRINTED OFFERS AND END-CONSUMER RE-DISTRIBUTION OF PRINTED WORKS

BACKGROUND OF INVENTION

1. Field of Invention

The field of the present invention generally relates to a method for reducing the proffer of expired documents and consumer re-distribution of printed publications. In particular, the present invention discloses a method for the time-delayed defacement of all or part of a printed work.

2. Brief Description of the Prior Art

Even with the advent of the electronic media, the print media continues to grow and thrive. Millions of fliers, documents, papers and manuscripts are printed daily. Sales of printed works account for a significant portion of the gross national product. Printed works continue to edify, inspire and amuse hundreds-of-millions of people. Such works are used to memorialize the wide-ranging transactions, and offer of transactions, which we encounter in our every day life.

Many printed works are intended for limited distribution or proffer. For example, printed promotional offers are often confined to a set period of time. Likewise, certain confidential documents are intended to be read by only a small group of people and thereafter discarded. Further, a certain number of copies of the first printing of a book are often distributed pro gratis in order to elicit enthusiasm for the work.

One particularly prevalent form of printed work intended for limited proffer is the time-dependent promotional offer known as the "consumer-good coupon". Consumer-good coupons have long been distributed by manufacturers to merchandise their products and by retail stores to attract consumers to their particular stores. As every shopper knows, consumer-good coupons are frequently distributed through the mail, newspapers, magazines, in consumer-good packages, and at the time of purchase by clerks. Coupons almost invariably are in the form of printed matter.

Numerous systems have been proposed and commercialized to improve the distribution and redemption of consumer-product coupons. A significant problem, however, unresolved by these systems is the means by which consumers and, to a lesser extent, retailers are informed of the expiration date of the coupon.

Coupon expiration dates are conventionally nearly always printed in small type. Consumers not infrequently attempt to pass off invalid coupons to retailers—more often unintentionally, to their embarrassment and frustration, but sometimes intentionally. Manufacturers not infrequently refuse to honor such coupons. Unless, as known in the art, the coupon is electronically coded with an identifier, and the retailer is supplied by the manufacturers with a database correlating the identifiers with product, expiration date and price information, the retailer is reliant upon the store clerks to assure that valid coupons are being accepted.

In the same vein, many documents are printed with the intention that their distribution be limited. Limited distribution may be desired to keep information within a defined group of people, or in order to permit the publisher to receive adequate compensation for publishing the work.

Clearly, the number sales of a particular printed work is limited not only by the total number of consumers who wish to read the work, but also by the number of end-consumers who share the work with others. For every person sharing a particular work with another, the publisher looses out on one potential sale.

Consumer re-distribution of printed works is a significant problem for many copyright holders and their publishers. A novelist, and the novelist's publisher, may loose hundreds-of-thousands of sales by the practice of re-distribution. It is not uncommon for a novel to be circulating for decades between consumers who have never paid the novelist or the novelist's publisher a royalty. Likewise, newspapers loose a significant number of sales each day due to the re-distribution of a paper which was paid for only once.

Likewise, numerous documents are printed every day in draft form. Such drafts are often confidential and for review by a select few. A discarded draft, however, which is not appropriately shredded is open to the purview of anyone who happens to pick it up.

OBJECTS AND SUMMARY OF PRESENT INVENTION

Accordingly, it is an object of the present invention to provide for a method of reducing the tender of time-expired documents and the re-distribution of printed works intended for limited circulation.

This object is attained in accordance with one aspect of the present invention directed to a method for the time-delayed defacement of all or part of a printed work. Such method comprises applying opaque print, that is, visible print, onto a substrate and applying an opacity-labile composition of lesser nascent opacity than the visible print onto the substrate in such a manner that a change in the opacity of the opacity-labile composition causes a time-delayed defacement of the printed substrate.

In one embodiment of this aspect of the invention, an acid- or base-sensitive chromophoric composition is applied to deface the printed substrate. For example, spirodipyran becomes considerably more opaque as it is exposed to acid conditions. An acidic chromophore-activating agent such as the multivalent-metal-modified salicylic acid resin and a polycondensation resin composition disclosed in U.S. Pat. No. 5,376,615, may be used to activate an acid-sensitive chromophore. When it is desired to carefully control the time over which chromophore development takes place, acid or base chromophore-activating agents may be encapsulated in time-release polymeric compositions, such slow-release polymer-based encapsulating techniques being well known in the art. Appropriate control release formulations may include ethylene vinyl aetate, polyanhydrides, polyorthoesters, polylactic acid and others. Release of the acid or base may be by simple degradation of the encapsulating wall by the chromophore-activating agent over time, or as described in U.S. Pat. No. 4,923,753 entitled "Controlled-release compositions for acids," by means of exogenous environmental degradation, such as hydration of the encapsulating coating. Release rate may be controlled in the conventional manner including varying the thickness of the encapsulating coating, the chromophore-activating agent enclosed, and by varying chosing encapsulating polymers of appropriate porosity. An agent that degrades over time to release acidic or basic moieties may also be used in the chromophoric composition. For example, o-nathoquinone diazide-4-sulfonic acid halide is described in U.S. Pat. No. 3,969,118 to be a photosensitive composition capable of releasing an acid moiety over time upon photo-exposure. Likewise, U.S. Pat. Nos. 4,160,671 and 4,232,106 describe a trihalomethyl compound capable of releasing an acid moiety upon photo-exposure.

In another embodiment of this aspect of the present invention, a light-sensitive chromophore composition of lesser nascent opacity than the opaque print is applied in proximity to or on the portion of the substrate where the opaque print will be placed. The opaque print is then printed on that portion of the substrate. The light-sensitive chromophore composition in this embodiment becomes considerably more opaque when exposed to light than in its nascent state. Preferably transmission should be reduced by at least approximately one-half upon light exposure. Preferably change in opacity should be gradual such that the reader of the opaque print can read the printed work before defacement occurs.

Light-sensitive chromophore compositions are well known in the art. For example, U.S. Pat. No. 5,227,473 describes a visible light-sensitive chromophore composition comprising a quinone diazide compound which increases in opacity upon exposure to light. Further, U.S. Pat. No. 3,969,118 describes a salt-forming organic dye which reacts with o-napthoquinone diazide-4-sulfonic acid halide when exposed to light to form a visible image. U.S. Pat. Nos. 4,160,671 and 4,232,106 also describe a light sensitive combination consisting of a trihalomethyl compound with a salt-forming organic dye. The art of photochemistry is described in N.J. Turro, *Modern Molecular Photochemistry*, Vol. 9 (Benjamin/Cummings Publishing Co. 1978).

In another embodiment of this aspect of the invention, a heat-sensitive chromophoric composition is applied to efface the opaque print. Such heat-sensitive compositions are well known in the art are responsible for the well known darkening of heat-sensitive paper over time.

In another embodiment of this aspect of the invention a water-sensitive chromophoric composition is applied to efface the opaque print. For example, benzoleucomethylene blue undergoes slow color change due to hydrolysis and subsequent oxidation. This chromophore continues to darken as time goes on. Efficiency of color development may be improved by adding a desiccant to the chromophoric composition to increase hydrolysis of the chromophore. Oxidizing agents may also be included.

The object of this invention is also attained in another aspect of the present invention directed to a method for the effacement of part of a printed work comprising applying opacity-labile print to select portions of an otherwise opaque printed work.

In an embodiment of this aspect of the invention, a work is printed in selected areas with a poor lightfastedness chromophore such as malachite green lactone or crystal violet lactone (i.e., triarylmethane-phthalide). Chromophores of this type fade in opacity over time. Other types of "disappearing inks" are also encompassed with the ambit of the present invention.

Methods for reducing or enhancing the rapidity of fade of a poor lightfastedness chromophore, and the rapidity of change in opacity produced by a opacity-labile chromophore are well known in the art.

In yet another embodiment, the paper on which the opaque print is placed is coated with the a opacity-labile chromophore composition of lesser nascent opacity than the opaque print.

The object of this invention is also attained in disclosing a method for the time-delayed defacement of all or part of a time-dependent printed work comprising: applying opaque print to a substrate; applying an opacity-labile composition of lesser nascent opacity than said opaque print on or in proximity to said opaque print in such a manner that a change in the opacity of the opacity-labile composition causes a defacement of said printed work which is indicative of the time-dependent status of said printed work.

As would be known to one of ordinary skill in the art, numerous colorless or light-colored dyestuff precursors may be employed in the embodiments disclosed. Illustrative of these dyestuffs are fluoran compounds such as 3-dibutylamino-6-methyl-7-anilinofluoran, pyridylphthalide compounds, phenothiazine compounds and leucoauramine compounds. Color developing chromophore-activating agents include inorganic solid acids such as acid clay and attapulgite as disclosed in U.S. Pat. No. 2,712,507, substituted phenols and diphenols as disclosed in Japanese Patent Publication No. 9309/1965, p-substituted phenol-formaldehyde polymers, as disclosed in Japanese patent Publication No. 20144/1967 and metal salts of aromatic carboxylic acids as disclosed in U.S. Pat. No. 3,983,292.

It should be understood that because of the large number of printing inks available in the art, the numerous types of substrates on which printing inks are placed, and the large variety of printed articles themselves, the particular opacity-labile chromophore and chromophore-activating agent, as well as any polymers which may used to encapsulate the same, must be individually-tailored to produce discoloration at the desired time and of a desired hue. That is, the optimal time to defacement may vary substantially between printed works. For example, a complimentary print of a novel might be printed at select locations with a slow forming opacity-labile chromophore while a newspaper might be printed at select locations with a faster forming opacity-labile chromophore.

There are many possible modifications and changes which could be made to the system without straying from the applicant's present invention. Such modifications would be obvious to those skilled in the art and should not limit the scope of applicant's claimed invention. For example, other means for producing a hybridization of a chromophore from sp3 to sp2 and thus forming color can be used.

BRIEF DESCRIPTION OF THE DRAWINGS

The present invention will be understood and appreciated more fully from the following detailed description, taken in conjunction with the drawings in which:

FIG. 3 is an exemplary embodiment of the claimed invention wherein opacity-labile print is used to reduce the re-distribution of newsprint.

FIG. 4 is an exemplary embodiment of the claimed invention wherein opacity-labile print is used to reduce end-consumer re-distribution of a book.

DETAILED DESCRIPTION OF THE ILLUSTRATIVE EMBODIMENT OF THE PRESENT INVENTION

Figure 1:
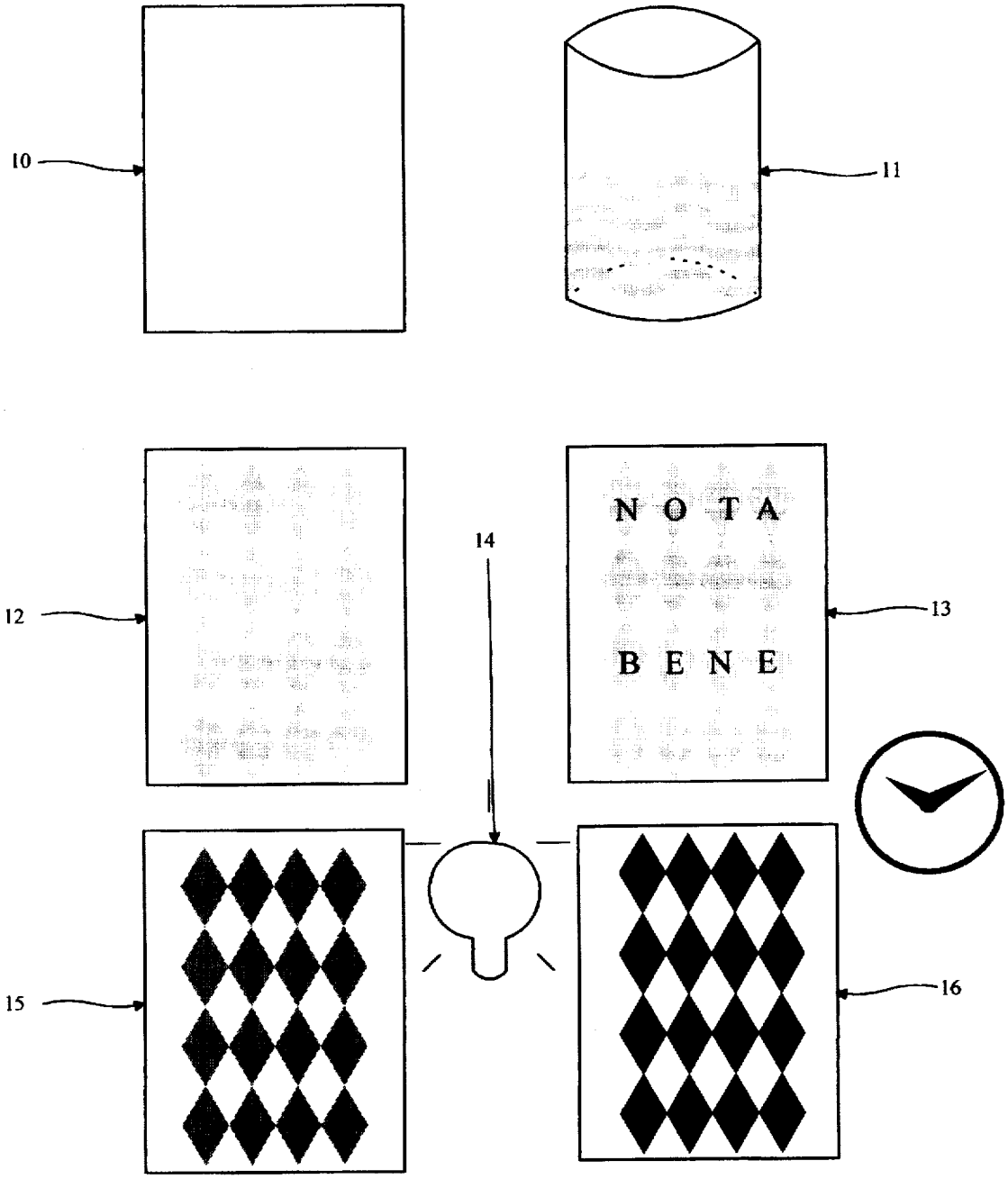
FIG. 1 is a schematic of the method encompassed in an embodiment of the present invention.

Referring to FIG. 1 of the drawings, a method for causing the time-delayed defacement of a printed publication is outlined. A opacity-labile chromophoric composition of low nascent opacity is prepared (11) and is applied to a substrate (10) so as to form an opacity-labile printed substrate (12). Opaque print is placed in a position such that it will be defaced when the opacity-labile chromophoric composition is activated to become more opaque (13). Activation of the opacity-labile chromophore is by means specific to the lability of the chromophore, in this case light (14). The activated opacity-labile chromophoric composition gradually darkens (15) causing a defacement of the opaque print printed on top of it (16).

Figure 2:
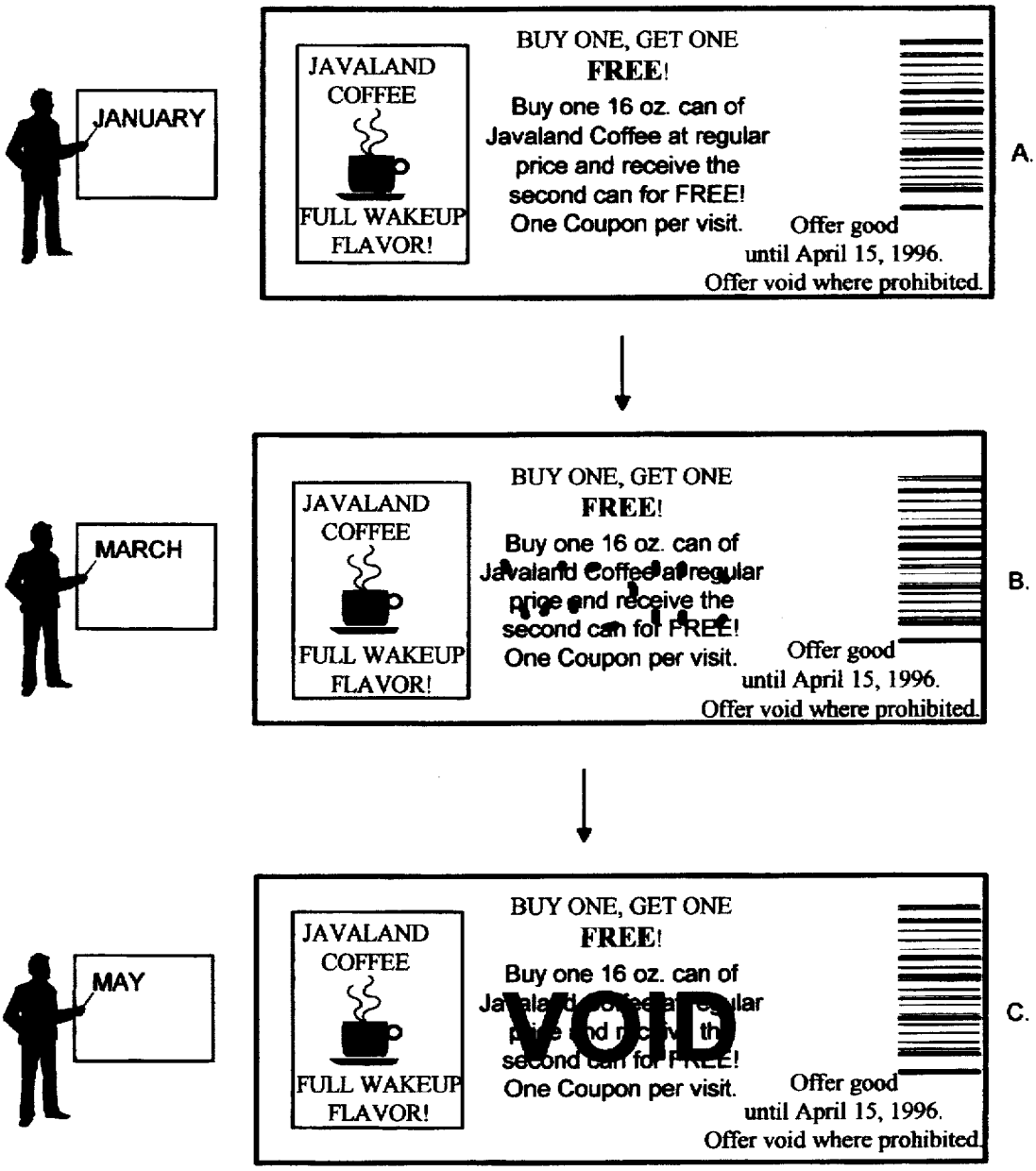
FIG. 2 is an exemplary embodiment of the claimed invention wherein opacity-labile print is used to warn transacting parties that a coupon has or is about to expire.

Referring to FIG. 2 of the drawings, there is shown an exemplary embodiment of the claimed invention wherein opacity-labile print is used to warn transacting parties that a coupon has or is about to expire. Opacity-labile print is placed on a coupon such that the print is invisible, or approximating invisible, at the time of distribution (A). Upon the passage of time, the opacity-labile print darkens, such that the word "VOID" begins to become visible at approximately the time the coupon is to expire (B). After the expiration date passes, the opacity-labile print continues to darken to warn both transacting parties that the coupon is no longer valid (C).

Referring now to FIG. 3, there is shown an exemplary embodiment of the claimed invention wherein opacity-labile print is used to reduce the re-distribution of newsprint. Opacity-labile print is placed over or under visible by-line in the newspaper. As time passes, the opacity-labile print develops opacity and becomes visible defacing the by-line (A–C). Defacement deters persons from attempting to read a paper purchased by another. Preferably such print is placed in select locations in the newspaper, such as over the scores in the sports section or, as shown, over lead stories. Further it is preferred that the print permit leisurely reading of an article by the purchaser but develop to a sufficient degree thereafter to dissuade others from reading the same paper. If light-sensitive opacity-labile print is used, preferably the by-line which is to be defaced is located within the paper such that opacity-development begins to occur only upon opening the paper.

And referring to FIG. 4, there is shown an exemplary embodiment of the claimed invention wherein opacity-labile print is used to reduce the re-distribution of a book. A key portion of the book (A) is coated at select points with the opacity-labile chromophore, such that development of the chromophore interferes with the enjoyment of the book (B). It will be appreciated that the opacity-labile chromophore composition chosen for this application would likely permit the original purchaser of the book to read the key portions of the book over a prolonged period of time, for example six months, but cause defacement within, for example, one or two years time thereafter.

What is claimed is:

1. A method for the time-delayed defacement of all or part of a printed work comprising:

applying opaque print to a substrate to form said printed work;

applying an opacity-labile composition, labile to changes in heat, acid, base or water, of lesser nascent opacity than said opaque print on or in proximity to said opaque print in such a manner that a change in the opacity of the opacity-labile composition causes a defacement of said printed work.

2. The method of claim 1 wherein said opacity-labile composition comprises a chromophoric composition.

3. The method of claim 1 wherein said opacity-labile composition is substantially protected from the environment ambient to the opacity-labile composition in a material capable of being degraded by the environment exogenous or endogenous to the degradable material.

4. The method of claim 1 wherein said opacity-labile composition is activated to change opacity by an activating agent.

5. The method of claim 4 wherein said activating agent is substantially protected from the environment ambient to the opacity-labile composition in a material capable of being degraded by an environment exogenous or endogenous to the degradable material.

6. The method of claim 1 wherein said opacity-labile composition does not develop in a progressive manner.

7. The method of claim 1 wherein the printed work is selected from the group consisting of: books, novels, or newsprint.

8. The method of claim 1 wherein the printed work is selected from the group consisting of: consumer-good coupons, promotional materials or confidential documents.

9. A method for the time-delayed defacement of all or part of a printed work designed for time-limited distribution, re-distribution, acceptance or transaction comprising:

applying print to a substrate to form said printed work;

providing an opacity-labile composition which can change opacity and result in defacement of a printed work if not protected from the environment to which it is to be exposed;

encapsulating said opacity-labile composition with a coating of degradable material which degrades when exposed to an environment capable of degrading said degradable material, to form an encapsulated composition;

applying the encapsulated composition to said printed work;

exposing said encapsulated composition to an environment capable of degrading said degradable material which changes the opacity of said opacity-labile composition and results in the defacement of said printed work.

10. The method of claim 9 wherein said change in opacity of said opacity-labile composition is substantial about or after the time said distribution, re-distribution, acceptance or transaction of said printed work is set to expire, but not prior to said time.

11. The method of claim 10 wherein at said time light transmission through said opacity-labile composition is reduced by approximately one-half that of said opacity-labile composition when first applied to said print.

12. The method of claim 9 wherein said print, or portion of said print, is opacity-labile.

13. The method of claim 9 wherein said opacity-labile composition is a chromophoric composition.

14. The method of claim 9 wherein said opacity-labile composition is activated to change opacity by an activating agent.

15. The method of claim 9 wherein said activating agent is time-released in a controlled manner.

16. A method for the time-delayed defacement of all or part of a printed work designed for time-limited distribution, re-distribution, acceptance or transaction comprising:

applying print to a substrate to form said printed work;

providing an opacity-labile composition which can change opacity and result in a defacement of a printed work;

providing an activating agent composition which can activate said opacity-labile composition to change opacity;

encapsulating said activating agent with a coating of degradable material which degrades when exposed to an environment capable of degrading said degradable material, to form an encapsulated activating agent composition;

applying said opacity-labile composition and said encapsulated activating agent composition to said printed work;

exposing said encapsulated activating agent composition to an environment capable of degrading said degradable material which changes the opacity of said opacity-labile composition and results in the defacement of said printed work.

17. The method of claim 16 wherein said change in opacity of said opacity-labile composition is substantial about or after the time of said distribution, re-distribution, acceptance or transaction of said printed work is set to expire, but not prior to said time.

18. The method of claim 17 wherein at said time light transmission through said opacity-labile composition is reduced by approximately one-half that of said opacity-labile composition when first applied to said substrate.

19. The method of claim 16 wherein said print, or portion of said print, is opacity-labile.

20. The method of claim 16 wherein said opacity-labile composition is time-released in a controlled manner.

* * * * *